US005586520A

United States Patent [19]

Cleary

[11] Patent Number: 5,586,520

[45] Date of Patent: Dec. 24, 1996

[54] METHOD OF MAINTAINING THE APPEARANCE OF EQUESTRIAN JUMPS

[76] Inventor: Timothy J. Cleary, 250 Round Swamp Rd., Melville, N.Y. 11747

[21] Appl. No.: 329,325

[22] Filed: Oct. 26, 1994

[51] Int. Cl.[6] ..... A01K 15/02

[52] U.S. Cl. ..... 119/705

[58] Field of Search ..... 119/705, 706; 256/59; 482/15, 16, 17

[56] References Cited

U.S. PATENT DOCUMENTS

| | | | |
|---|---|---|---|
| 2,005,817 | 6/1935 | Yoder | 119/706 |
| 2,119,808 | 6/1938 | Fecht . | |
| 2,827,116 | 3/1958 | Zalovcik | 119/705 |
| 2,894,487 | 7/1959 | Goldson | 11/706 |
| 3,061,306 | 10/1962 | Magill | 482/16 |
| 4,220,316 | 9/1980 | Naka et al. | 256/59 |
| 4,461,461 | 7/1984 | Caron | 256/59 |
| 4,516,756 | 5/1985 | Beatty | 256/1 |
| 4,946,139 | 8/1990 | Tomellini | 119/705 |

FOREIGN PATENT DOCUMENTS

| | | | |
|---|---|---|---|
| 2161720 | 7/1973 | France | 119/705 |
| 977383 | 12/1964 | United Kingdom . | |
| 2059784 | 4/1981 | United Kingdom | 482/16 |

*Primary Examiner*—Todd E. Manahan
*Attorney, Agent, or Firm*—Donald S. Dowden

[57] ABSTRACT

A removable cover is adapted to be slipped over a rail or other element of an equestrian jump that should present a desired set appearance but is subject to degradation in the appearance. The cover is formed of a cleanable sheath having a length substantially parallel to a principal dimension of a jump element, an opening for insertion of the jump element, and interior dimensions substantially corresponding to exterior dimensions of the jump element so that the sheath can be slipped over the jump element and surround at least a portion thereof. When the appearance of the cover becomes degraded, it can be removed from the jump element, cleaned, and slipped over the jump element to restore the desired set appearance.

3 Claims, 3 Drawing Sheets

METHOD OF MAINTAINING THE APPEARANCE OF EQUESTRIAN JUMPS

BACKGROUND OF THE INVENTION

1. Field of the Invention

This invention relates to a process and apparatus for maintaining the appearance of a hurdle or barrier structure, and more particularly to a removable cover for various parts, especially rails, of equestrian jumps.

2. Description of the Prior Art

For competitive, commercial and aesthetic reasons, producers of horse shows and managers of equestrian facilities that use jumps go to great lengths to keep the jumps freshly painted, often with contrasting colors, and neat in appearance. Jumps commonly used include posts and rails forming imitation fences, plus imitation gates and walls. For safety, the jumps are usually constructed to collapse when struck by a horse.

Jumps quickly become dirty in dusty or muddy riding rings from contact with horses, dirt or mud kicked up by the horses, and especially from being knocked to the ground. Also, the appearance of portable jumps deteriorates from handling as they are loaded into and unloaded from trucks and dropped or placed on truck beds or the ground. Washing a jump is of limited utility since washing does not replace missing or faded paint and after repeated soiling fails to restore a jump to pristine condition. Moreover, washing is time and labor intensive, inconvenient and costly.

In practice, the wear, tear and general abuse to which jumps are subjected requires that they be repainted frequently in order to maintain their appearance, even though, as compared to washing, painting a horse jump is even more time and labor intensive, inconvenient and costly.

Jumps are often made of wood but can also be made of plastic and some other lightweight materials. While plastic may provide a more durable finished appearance than wood and may not require repainting, plastic jumps deteriorate in appearance because of fading, scuffing and soiling, and in time, despite careful washing, become unsightly and unusable in major competition.

It has been proposed to protect various wooden structures with a plastic or rubber sheath. Examples of patents relating to such proposals are a U.S. Pat. No. 4,516,756 to Beatty and a British patent No. 977,383 to Trobridge. The Beatty patent discloses a hollow plastic sheath molded with a desired pigment and placed over an element of a picket fence to avoid the need for repainting. The Trobridge patent discloses a protective and resilient rubber sheath formed with cavities and encasing a jumping rail to avoid injuries occasioned by a splintered rail. However, the sheaths disclosed in the Beatty and Trobridge patents share the disadvantages that they are relatively heavy, expensive and inconvenient to use, that their appearance is degraded when they become soiled, and that they are not conveniently removable and cleanable. Other patents of interest are a U.S. patent to Fett No. 2,119,808, which discloses an automatic hurdle of the type used for athletic purposes (track and field), and a U.S. patent to Naka No. 4,220,316, which discloses a top rail for use with a staircase. The top rail is formed of a rigid synthetic resin such as polyvinyl chloride, polycarbonate, acrylate resin, and melamine.

The current state of the art provides no solution to the problems outlined above and in particular no economical way of maintaining equestrian jumps in pristine condition.

OBJECTS AND SUMMARY OF THE INVENTION

An object of the invention is to provide a remedy for the problems of the prior art noted above and in particular a simple and inexpensive way of maintaining the appearance of an equestrian jump. Another object of the invention is to make the production of horse shows and the management of equestrian facilities easier, more efficient, and less expensive.

The foregoing and other objects are attained in accordance with the invention by providing a removable cover adapted to be slipped over an element of an equestrian jump that should present a desired set appearance but is subject to degradation in the appearance. The cover comprises a cleanable sheath having a length substantially parallel to a principal dimension of the jump element, an opening for insertion of the jump element, and interior dimensions substantially corresponding to exterior dimensions of the jump element so that the sheath can be slipped over the jump element and surround at least a portion thereof. Thus when the appearance of the cover becomes degraded, the cover can be removed from the jump element, cleaned, and slipped over the jump element to restore the desired set appearance.

In accordance with an independent aspect of the invention, there is provided the combination of an equestrian jump formed with at least one rail that should present a desired set appearance but is subject to soiling and a removable cover adapted to be slipped over the rail. The removable cover comprises a stretchable, washable, woven fabric sheath having a length substantially coextensive with a principal dimension of the rail, at least one opening for insertion of the rail, interior dimensions substantially corresponding to exterior dimensions of the rail so that the sheath can be slipped over the rail and surround at least a portion thereof, and an appearance that simulates that of the rail. Thus when the cover becomes soiled it can be removed from the rail, cleaned, and slipped over the rail to restore the desired set appearance.

Finally, in accordance with the invention, there is provided a method of maintaining a set appearance of at least one element of an equestrian jump that is subject to soiling. The method comprises the steps of encasing the jump element in a cover substantially coextensive with a length thereof, removing the cover when it is soiled, cleaning the cover, and reapplying the cover to the jump element.

BRIEF DESCRIPTION OF THE DRAWINGS

A better understanding of the objects, features and advantages of the invention can be gained from a consideration of the following detailed description of the preferred embodiments thereof, in conjunction with the appended figures of the drawing, wherein.

DESCRIPTION OF THE PREFERRED EMBODIMENTS

Figure 1:
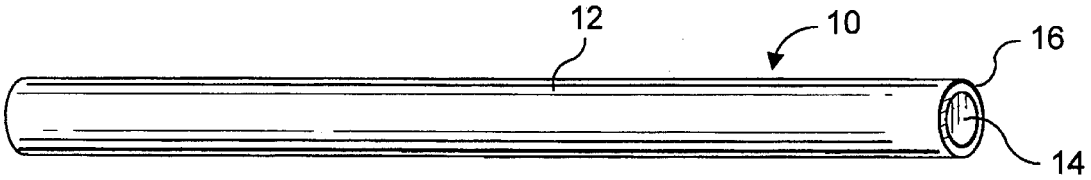
FIG. 1 is perspective view of a jump rail provided in accordance with the invention with a cover of one solid color.
Figure 2:
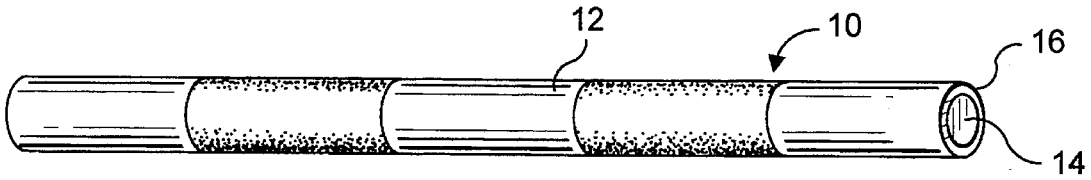
FIGS. 2, 3 and 4 are views similar to FIG. 1 showing three different striped patterns.
Figure 3:
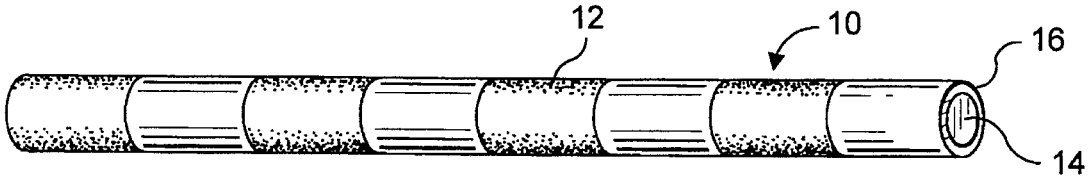
Figure 4:
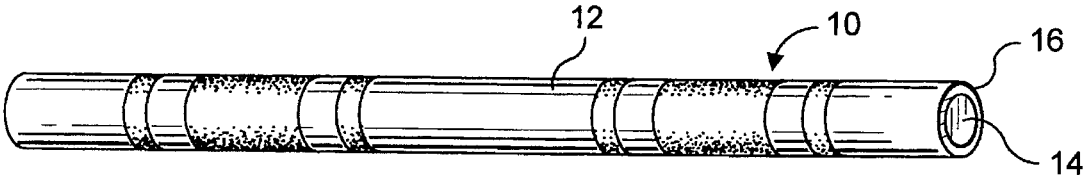

FIGS. 1–4 show rails 10 respectively provided with various covers 12. In FIG. 1, the cover 12 is of a solid cover (white, red, blue, yellow, etc.). In FIG. 2, a first striped pattern is employed, in FIG. 3 a second, and in FIG. 4 a third. The striped patterns can be formed by any two or more different colors (black and white; blue and white; red and white; red and green; blue and gold; red, white and blue; etc.; the possibilities are endless).

In FIGS. 1–4, the cover 12 is shown as having substantially the same length as the rail 10, so that each end 14 of the rail 10 and each end 16 of the cover 12 lie substantially in the same plane. However, it is possible in accordance with the invention to make the cover 12 either longer or preferably shorter than the rail 10. For example, in order to avoid abrasion of the cover by the cup in which the rail 10 is supported (see FIG. 8), the cover 12 can be made somewhat shorter than the rail 10 so that, when the cover 12 is substantially centered with respect to the rail 10, an end 14 of the rail 10 extends beyond the end 16 of the cover 12 far enough that the cover 12 does not make contact with the cup 18. The cover in preferably tubular (open at both ends) but can be a "sock" (closed at one end).

Figure 5:
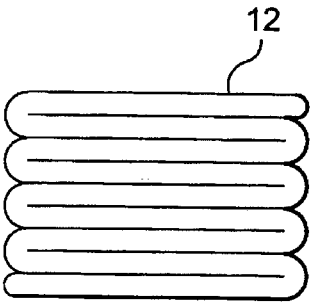
FIG. 5 is a view in side elevation showing a cover constructed in accordance with the invention and given a serpentine fold so that it can be packaged for storage and shipment.
Figure 6:
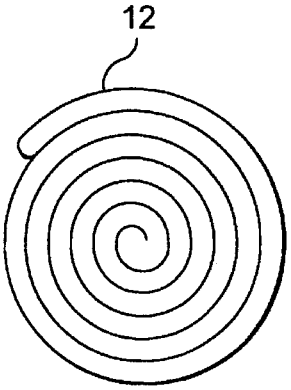
FIG. 6 is a view similar to FIG. 5 showing the cover rolled for storage and shipment.

FIG. 5 shows the cover 12 in a serpentine fold. Given the size of a typical rail 10 (a few meters in length and several centimeters in diameter), a fabric cover for it can be folded into a package measuring about 4 inches by 6 inches by 6 inches (about 10 centimeters by 15 centimeters by 15 centimeters). FIG. 6 shows an alternative configuration of the cover 12 for storage and shipment: the cover is rolled from one end to the other, producing a package of about the same size as the one resulting from a serpentine fold.

Figure 7:
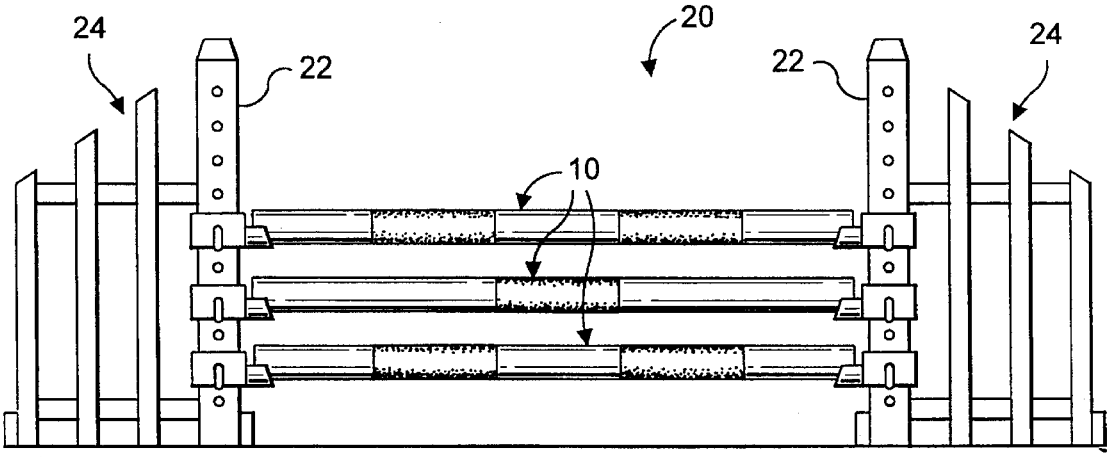
FIG. 7 is a view in elevation of a typical equestrian jump of the type used in horse shows including posts and several rails of the type illustrated in FIGS. 1–4.

FIG. 7 shows a jump 20 comprising three rails 10, a pair of posts 22 supporting the rails 10, and decorative fencing 24 extending from the posts 22 in opposite directions away from the rails 10. The three rails are respectively supported by three pairs of cups.

Figure 8:
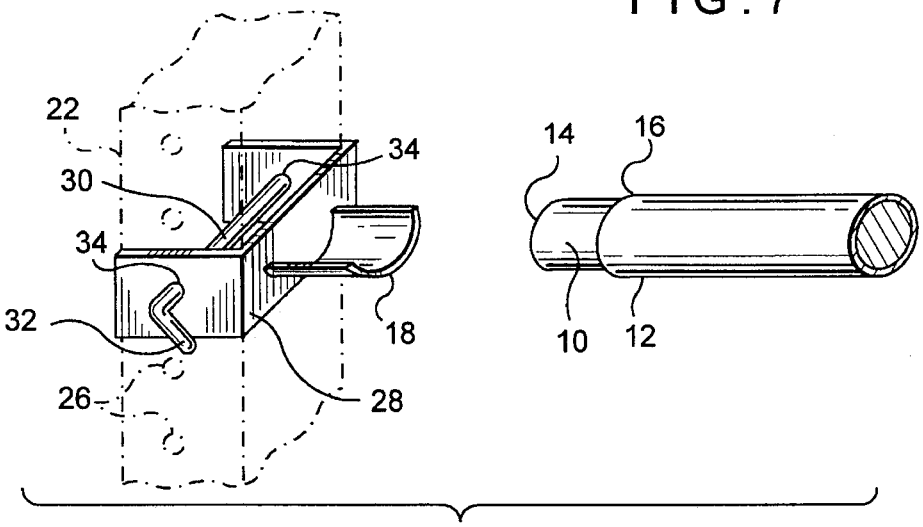
FIG. 8 is a perspective view showing the positioning of one end of a rail in a supporting cup attached to a post.

As FIG. 8 shows, each post 22 is formed with a series of holes 26 extending through the post from one side to the other. Each cup 18 is attached to a bracket 28 that extends around three sides of the post 22, and a pin 30 having a bent end 32 is passed through holes 34 in the bracket 28 and through a selected hole 26. The holes 26 are at different heights that are matched from one post 22 to the other, so that a rail the ends of which are respectively supported by a pair of cups can be leveled. The height of the jump can easily be adjusted by withdrawing the pin 30, moving the bracket 28 to the desired height so that the holes 34 in the bracket are aligned with a desired hole 26, and inserting the pin 30 through the holes 34 and 26. The brackets are adjusted on both sides of the jump so that the rail 12 remains level.

Figure 9:
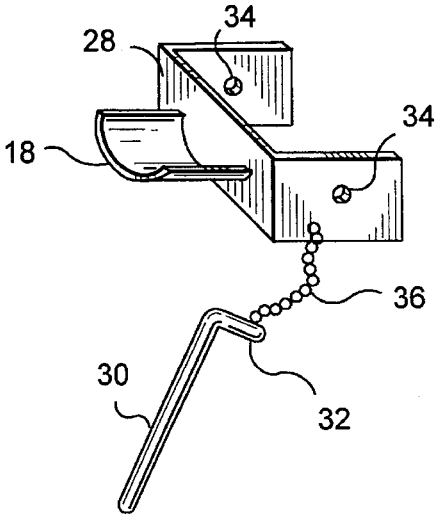
FIG. 9 is a perspective view of the cup, a bracket attached to the cup, and an attachment pin by which the bracket is removably mounted on the post.

As FIG. 9 shows, the pin 30 is secured to the bracket 28 in any convenient way, for example by a chain 36 attached to the bent end 32 of the pin 30, so that the pin 30 is not likely to be lost.

As FIGS. 8 and 9 show, the cup 18 is concave facing up. It thus reliably holds an end of the rail 10, but the rail is easily knocked out of the cup if a horse catches it with a hoof while taking a jump. This is a safety precaution for both the horse and the rider. The cup 18 can even have a flat upper surface and can be made very small so that a slight touch will cause the rail to fall. It is thus unavoidable that the rails 10 will be repeatedly knocked to the ground during a horse show, especially since the rails are often set at a height intended to test the jumping ability of the horse.

The cover 12 is formed of a stretchable sheath and for example of a woven synthetic material. The colors of the cover 12 are of course not painted on but are dyed into the material of which the cover is woven. Colors imparted in this matter are more durable than a paint applied to a wood or plastic surface. The latter results in a surface coating which abrades and flakes off over time and is moreover difficult to clean. Obviously a jump rail cannot be thrown into a washing machine; rather, it must be cleaned in a manual, unautomated process that is labor intensive and time intensive. In contrast, a cover made in accordance with the invention can easily be thrown into a washing machine at the end of every show and restored essentially to its pristine condition.

Since the cover is preferably made of a stretchable material, it fits snugly around the rail. It is applied to the rail in much the same way that a stocking is slipped onto a leg. From a distance, the rail with the cover applied is essentially indistinguishable from a bare rail. If over time the two become distinguishable, it is only because the rail provided with a freshly washed cover in accordance with the invention looks better than a bare rail that has been repeatedly soiled and cleaned.

In accordance with the invention, it is not necessary that the various rails employed be painted with the various striped patterns etc. Instead, a generic rail can be employed, and different aesthetic presentations can be effected solely by the choice of covers. Thus all of the rails can be white or even left unpainted, and the desired appearance of the various jumps can be made to depend solely on the choice of covers. This greatly simplifies the inventory of rails and reduces the cost of maintaining an inventory.

Figure 10:
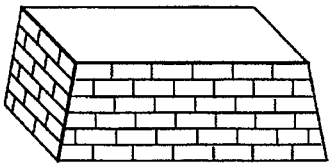
FIGS. 10 and 11 are perspective views of two forms of walls provided with covers in accordance with the invention.
Figure 11:
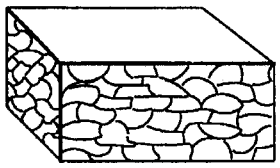

It is primarily the rails that are knocked to the ground and that need the protection afforded by the present invention. However, it is within the scope of the invention to protect other jump elements. FIGS. 10 and 11 show walls, "brick" in one case and "stone" in the other. These walls are in fact made of wood, plastic, pressed board or other suitable material that is not too heavy. The walls are moreover collapsible. In accordance with the invention, it is possible to encase an entire wall in an upside-down box-like cover with a design simulating a brick or stone wall. Alternatively, it is possible to separately enclose sections of the walls in covers and stack the sections to complete the walls. The latter technique favors the collapse of the walls when struck by a horse.

Figure 12:
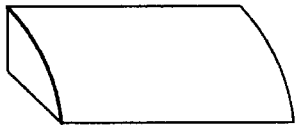
FIG. 12 is a perspective view of a "roll top" jump provided with a cover in accordance with the invention.
Figure 13:
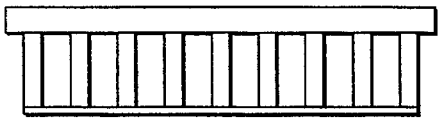
FIGS. 13–15 are views in elevation showing various forms of gates provided with covers in accordance with the invention.
Figure 14:
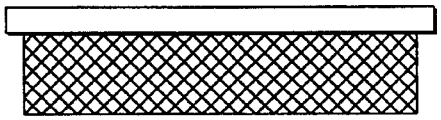
Figure 15:
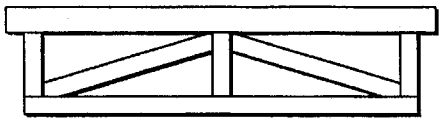
Figure 16:
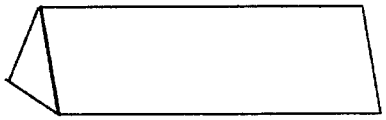
FIG. 16 is a perspective view of a coup provided with a cover in accordance with the invention.
Figure 17:
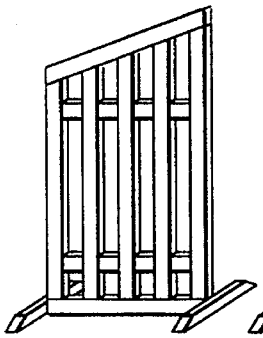
FIGS. 17, 18, 19 and 20 are perspective views of various other structures in common use in horse shows, each provided with a cover in accordance with the invention.
Figure 18:
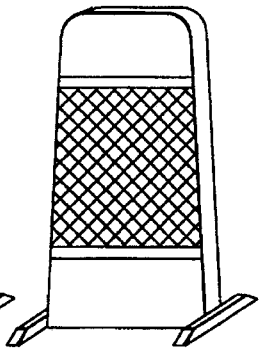
Figure 19:
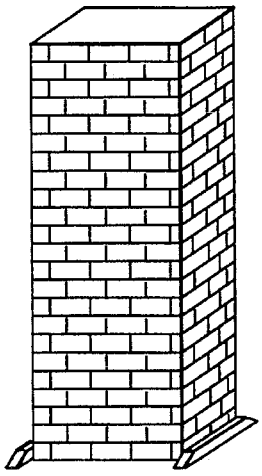
Figure 20:
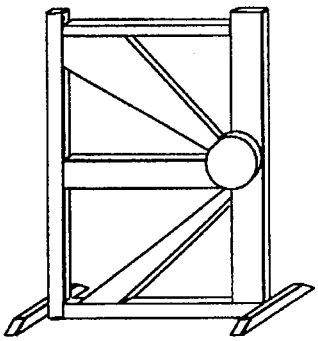

FIG. 12 shows a roll top that can be similarly protected using a single cover or multiple covers for separate sections. In the same way, the gates of FIGS. 13–15, the coup of FIG. 16 and the various upright structures of FIGS. 17–20 can be protected by a single cover or divided into stacked sections respectively protected by separate covers.

Thus there is provided in accordance with the invention a novel and highly effective apparatus and process that remedies the problems of the prior art noted above. The invention provides a simple and inexpensive way of maintaining the appearance of an equestrian jump and makes the production of horse shows and the management of equestrian facilities easier, more efficient, and less expensive.

Many modifications of the preferred embodiments of the invention disclosed above will readily occur to those skilled in the art. In particular, the materials of which the cover is made and the type of jump elements to which the covers are applied can be varied in any way suggested by the imagination of those working in the art. Accordingly, the invention extends to all apparatus and methods that fall within the scope of the appended claims.

I claim:

1. A method of maintaining a set appearance of at least one element of an equestrian jump that is subject to soiling, comprising the steps of:

encasing the jump element in a cover substantially coextensive with a length thereof;

removing the cover when it is soiled;

cleaning the cover; and reapplying the cover to the jump element.

2. A method according to claim 1 comprising the step of selecting for the encasing step a cover that is stretchable and fits snugly over the jump element.

3. A method according to claim 1 wherein the element is a rail, a post, a gate, a wall, a coup, or a roll top.

* * * * *